US007008257B2

(12) United States Patent
Zhu et al.

(10) Patent No.: US 7,008,257 B2
(45) Date of Patent: Mar. 7, 2006

(54) AUXILIARY FASTENING DEVICE FOR ASSISTING CABLE BEING FASTENED ONTO SURFACE OF ELECTRONIC APPARATUS

(75) Inventors: Ping-Ke Zhu, Su Zhou (CN); Yi-Lunmr Ho, Taoyuan (TW); Kuan-Hsu Lin, Taoyuan (TW)

(73) Assignee: Benq Corporation, Taoyuan (TW)

( * ) Notice: Subject to any disclaimer, the term of this patent is extended or adjusted under 35 U.S.C. 154(b) by 0 days.

(21) Appl. No.: 11/009,771

(22) Filed: Dec. 9, 2004

(65) Prior Publication Data

US 2005/0130488 A1 Jun. 16, 2005

(30) Foreign Application Priority Data

Dec. 10, 2003 (TW) ..... 92134937 A

(51) Int. Cl.
*H01R 39/00* (2006.01)

(52) U.S. Cl. ..... 439/470

(58) Field of Classification Search ..... 439/470–472, 439/459, 451, 452, 345, 369, 372; 349/719, 349/385; 174/117 F; 248/74.1, 74.2, 74.4, 248/316.5, 316.6

See application file for complete search history.

(56) References Cited

U.S. PATENT DOCUMENTS

| | | | | |
|---|---|---|---|---|
| 4,448,474 | A * | 5/1984 | Melnychenko | 439/472 |
| 4,516,822 | A * | 5/1985 | Wolfel | 439/468 |
| 5,382,179 | A * | 1/1995 | Noschese | 439/369 |
| 5,964,611 | A * | 10/1999 | Jacob et al. | 439/372 |
| 2001/0053626 | A1 * | 12/2001 | Wakino | 439/459 |

* cited by examiner

*Primary Examiner*—Tho D. Ta
*Assistant Examiner*—Felix O. Figueroa
(74) *Attorney, Agent, or Firm*—Ladas & Parry LLP

(57) ABSTRACT

The invention provides an auxiliary fastening device for assisting a cable being fastened onto a surface of an electronic apparatus, including a first connector disposed on the surface of the electronic apparatus. The cable includes a second connector adapted to the first connector and a plurality of signal lines coupled to the second connector. The auxiliary fastening device, according to the invention, includes a base having a top surface and a fastening member having a lower surface. When the second connector is connected to the first connector, by the fastening auxiliary fastening device according to the invention, the signal lines of the cable are disposed and fastened between the top surface of the fastening member, and the auxiliary fastening device is mounted onto the surface of the electronic apparatus.

12 Claims, 12 Drawing Sheets

AUXILIARY FASTENING DEVICE FOR ASSISTING CABLE BEING FASTENED ONTO SURFACE OF ELECTRONIC APPARATUS

BACKGROUND OF THE INVENTION

1. Field of the Invention

The present invention relates to an auxiliary fastening device for assisting a cable being fastened onto a surface of an electronic apparatus. There is a first connector disposed on the surface of the electronic apparatus. The cable includes a second connector adapted to the first connector. The auxiliary fastening device of the present invention can especially enable the second connector to be strongly connected to the first connector and avoid bad contact resulted from sudden external tensile force or even falling off. Furthermore, the manufacture cost of the auxiliary fastening device according to the present invention is inexpensive.

2. Description of the Prior Art

Most of the current electronic devices provide a first connector to communicate with external signals. Generally speaking, the cable, which connects the electronic device and external or internal signals, also has a second connector installed on one end, and this second connector is adapted to the first connector. For example, when a liquid crystal display (LCD) apparatus is fabricated, there is a first connector installed on the LCD panel. The interface board connected to the LCD panel utilizes a low voltage differential signaling (LVDS) cable to connect with the first connector of the LCD panel. On one end of the LVDS cable is a second connector adapted to the first connector of the LCD panel.

In general, the connection between the second connector of the cable and the first connector of the electronic device, without any auxiliary fastening device, is not strong. Therefore, bad contact will occur at the second connector that is connected to the first connector, or it may even fall off completely. Especially when there is sudden external tensile force on the cable, the above-undesired condition is more likely to occur.

To strengthen the connection between the second connector and the first connector, the prior art installs a pair of metal hooks on both sides of the second connector of the cable. The pair of metal hooks grips the first connector of electronic device. However, the strength of the metal hooks of the prior art is limited. When there is sudden external tensile force on the cable, the metal hooks of the prior art are easy to be deformed. Therefore, bad contact will still occur at the second connector that utilizes the metal hooks of the prior art to connect with the first connector.

Therefore, the objective of the present invention is to provide an auxiliary fastening device for assisting a cable being fastened onto a surface of an electronic apparatus and enabling the second connector of the cable to strongly connect with the first connector of the electronic device. According to the auxiliary fastening device of the present invention, especially, bad contact resulted from sudden external tensile force will not occur at the second connector connected to the first connector, nor will it even fall off.

Moreover, the manufacture cost of the metal hooks of the prior art is more expensive. The metal hooks of the prior art also have to match the size of the second connector of cable and the first connector of electronic apparatus, so that is more difficult to be utilized extensively.

Therefore, another objective of the present invention is to provide an auxiliary fastening device for strongly connecting the second connector of cable and the first connector of electronic apparatus. Furthermore, the manufacture cost of the auxiliary fastening device according to the present invention is inexpensive.

SUMMARY OF THE INVENTION

An auxiliary fastening device of a first preferred embodiment according to the present invention is used for assisting a cable being fastened onto a surface of an electronic apparatus. A first connector is disposed on the surface of the electronic apparatus. The cable comprises a second connector adapted to the first connector and a plurality of signal lines coupled to the second connector. The auxiliary fastening device of the first preferred embodiment according to the present invention comprises a base, a fastening member, and a clamping member. The base has a bottom surface and a top surface thereon defining a longitudinal direction and a transverse direction. A first side and a second side opposite to the first side are defined on the top surface in the transverse direction. The fastening member protrudes from the first side of the base in the transverse direction and has a tail end. The tail end is normally free and made in a form of a retainer. The tail end of the fastening member is selectively disposed in a closed position by bending the fastening member toward the top surface of the base. The fastening member also has a lower surface corresponding to the top surface of the base. The clamping member is disposed on the second side of the base. The tail end of the fastening member is made into the clamping engagement with the clamping member when the tail end of the fastening member is disposed in the closed position. When the second connector is connected to the fist connector, the signal lines are disposed on the top surface of the base. The tail end of the fastening member is then forced to the closed position such that the signal lines are disposed and fastened between the lower surface of the fastening member and the top surface of the base. Furthermore, the auxiliary fastening device is, via the bottom surface of the base, mounted onto the surface of the electronic apparatus.

An auxiliary fastening device of a second preferred embodiment according to the present invention is used for assisting a cable being fastened onto a surface of an electronic apparatus. A first connector is disposed on the surface of the electronic apparatus. The cable comprises a second connector adapted to the first connector and a plurality of signal lines coupled to the second connector. The auxiliary fastening device of the second preferred embodiment according to the present invention comprises a base, a fastening member, a first clamping member, and a second clamping member. The base has a bottom surface and a top surface thereon defining a longitudinal direction and a transverse direction. A first side and a second side opposite to the first side are defined on the top surface in the transverse direction. The fastening member has a first end and a second end which each is normally free and made in a form of a retainer respectively. The fastening member also has a lower surface corresponding to the top surface of the base. The first clamping member is disposed on the first side of the base and is capable of being made into the clamping engagement with the first end of the fastening member. The second clamping member is disposed on the second side of the base and is capable of being made into the clamping engagement with the second end of the fastening member. When the second connector is connected to the fist connector, the signal lines are disposed on the top surface of the base. The first end of the fastening member is then forced into the clamping engagement with the first clamping member, and the second end of the fastening member is forced into the clamping engagement with the second clamping member, such that the signal lines are disposed and fastened between the lower surface of the fastening member and the top surface of the base. Furthermore, the auxiliary fastening device is, via the bottom surface of the base, mounted onto the surface of the electronic apparatus.

The advantage and spirit of the invention may be understood by the following recitations together with the appended drawings.

BRIEF DESCRIPTION OF THE APPENDED DRAWINGS

DETAILED DESCRIPTION OF THE INVENTION

The present invention is to provide an auxiliary fastening device for assisting a cable being fastened onto a surface of an electronic apparatus and enabling a second connector of the cable to strongly connect with a first connector of the electronic device. A plurality of preferred embodiments according to the present invention are disclosed in the following.

Figure 1A:
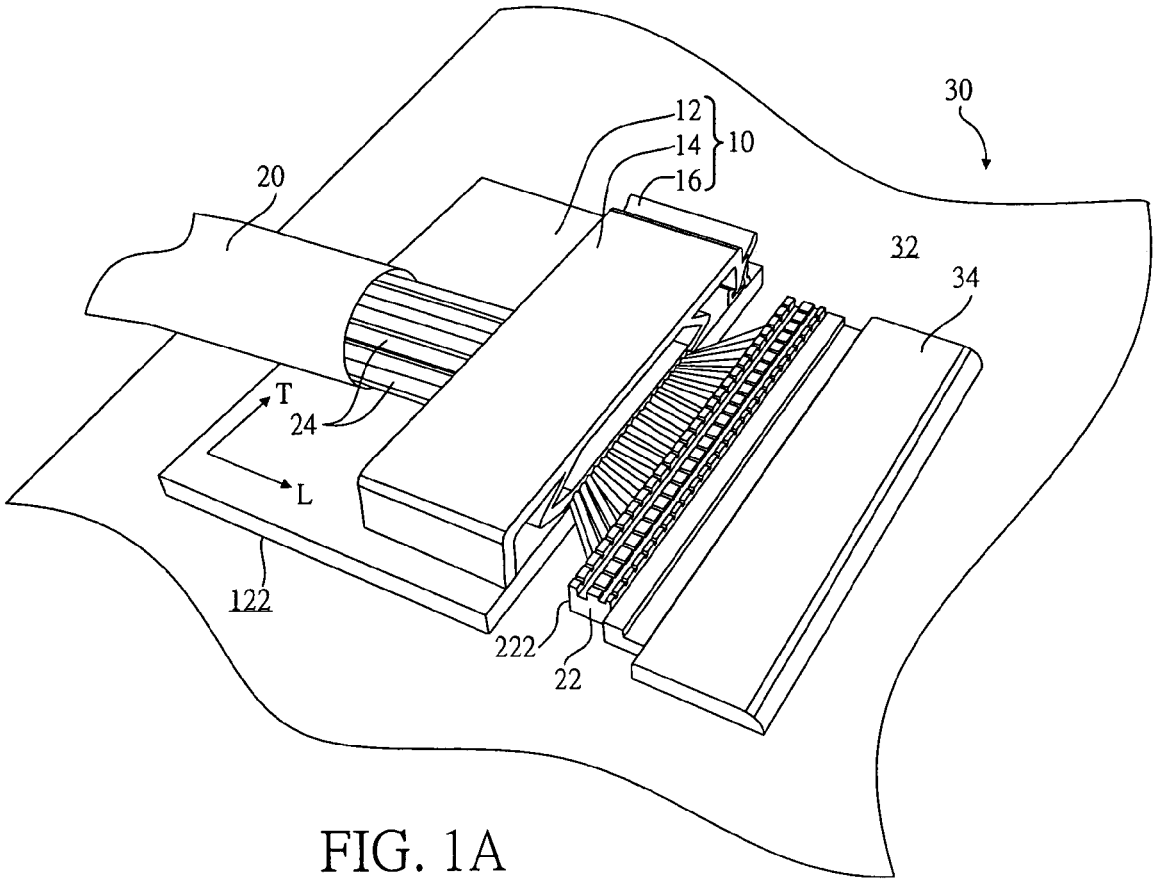
FIG. 1A is a schematic diagram of an auxiliary fastening device for assisting a cable being fastened onto a surface of an electronic apparatus of a first preferred embodiment according to the present invention.

Please refer to FIG. 1A to FIG. 1F. An auxiliary fastening device 10 of a first preferred embodiment according to the present invention is described in detail in the above figures. As shown in FIG. 1A, the auxiliary fastening device 10 is used for assisting a cable 20 being fastened onto a surface 32 of an electronic apparatus 30. A first connector 34 is disposed on the surface 32 of the electronic apparatus 30 for communicating with external signals. The cable 20 comprises a second connector 22 adapted to the first connector 34 and a plurality of signal lines 24 coupled to the second connector 22.

Figure 1B:
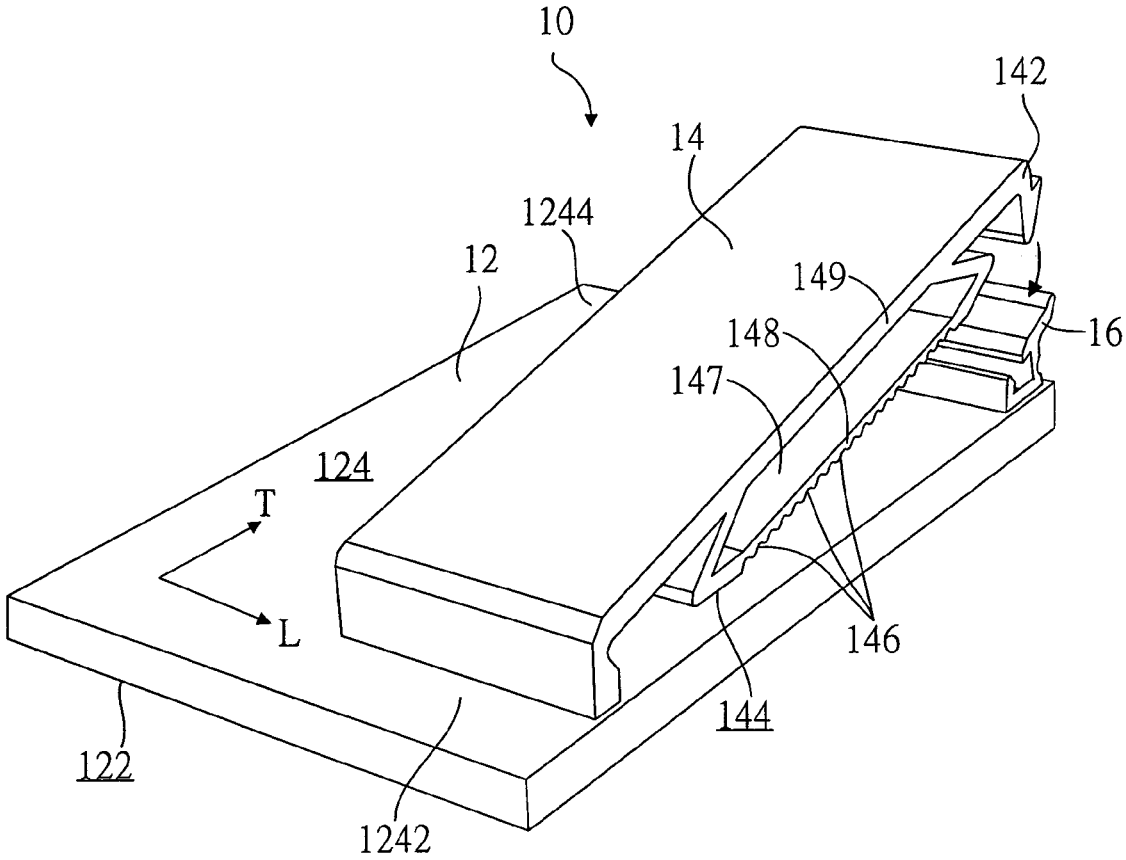
FIG. 1B is a schematic diagram of an auxiliary fastening device of a first preferred embodiment according to the present invention.

Please refer to FIG. 1B. The auxiliary fastening device 10 comprises a base 12, a fastening member 14, and a clamping member 16.

As shown in FIG. 1B, the base 12 has a bottom surface 122 and a top surface 124, thereon defining a longitudinal direction L and a transverse direction T. A first side 1242 and a second side 1244 opposite to the first side 1242 are defined on the top surface 124 in the transverse direction T.

As shown in FIG. 1B, the fastening member 14 protrudes from the first side 1242 of the base 12 in the transverse direction T and has a tail end 142. The tail end 142 is normally free and made in a form of a retainer. The tail end 142 of the fastening member 14 is selectively disposed in a closed position by bending the fastening member 14 toward the top surface 124 of the base 12. The fastening member 14 also has a lower surface 144 corresponding to the top surface 124 of the base 12.

As shown in FIG. 1B, the clamping member 16 is disposed on the second side 1244 of the base 12. The tail end 142 of the fastening member 14 is made into the clamping engagement with the clamping member 16 when the tail end 142 of the fastening member 14 is disposed in the closed position.

In the process of practical fabricating, first, the second connector 22 is connected to the first connector 34. Then, the signal lines 24 are disposed on the top surface 124 of the base 12. The tail end 142 of the fastening member 14 is then forced to the closed position, such that the signal lines 24 are disposed and fastened between the lower surface 144 of the fastening member 14 and the top surface 124 of the base 12. Finally, the auxiliary fastening device 10 is, via the bottom surface 122 of the base 12, mounted onto the surface 32 of the electronic apparatus 30. By this way, the auxiliary fastening device 10 assists the cable 20 being fastened onto the surface 32 of the electronic apparatus 30 and strongly connects the second connector 22 of the cable 20 and the first connector 34 of the electronic apparatus 30, as shown in FIG. 1A. In a preferred embodiment, the auxiliary fastening device 10 enables the base 12 to be attached to the surface 32 of the electronic apparatus 30. In another preferred embodiment, the auxiliary fastening device 10 fastens the base 12 on the surface 32 of the electronic apparatus 30 with at least one screw.

Obviously, when the cable 20 is pulled by sudden external tensile force, due to the fact that the auxiliary fastening device 10 can resist the sudden external tensile force, the second connector 22 connected to the first connector 34 will not have bad contact resulted from the sudden external tensile force, nor will it fall off.

In a preferred embodiment, as shown in FIG. 1B, the auxiliary fastening device 10 further comprises a plurality of grooves 146, which elongate in the longitudinal direction L; it also extends along the transverse direction T, and that is formed on the bottom surface 144 of the fastening member 14. As shown in FIG. 1A, the plurality of signal lines 24 is not in the form of a bundle but separated from each other near the second connector 22. Each of the grooves 146 is especially sized to accept one of the signal lines 24 of the cable 20. When the plurality of signal lines 24 are disposed and fastened between the bottom surface 144 of the fastening member 14 and the top surface 124 of the base 12, each signal line 24 is disposed and fastened in each of the grooves 146.

In a preferred embodiment, as shown in FIG. 1B, the fastening member 14 has a hollow portion 147 formed on the bottom surface 144, so that a retained portion 148 between the bottom surface 144 and the hollow portion 147 is deformable. By this way, when each signal line 142 is disposed and fastened in each of the grooves 146, a pressure induced by the deformed retained portion 148 is applied to the plurality of signal lines 24. Therefore, the auxiliary fastening device 10 can resist larger external tensile force.

Figure 1C:
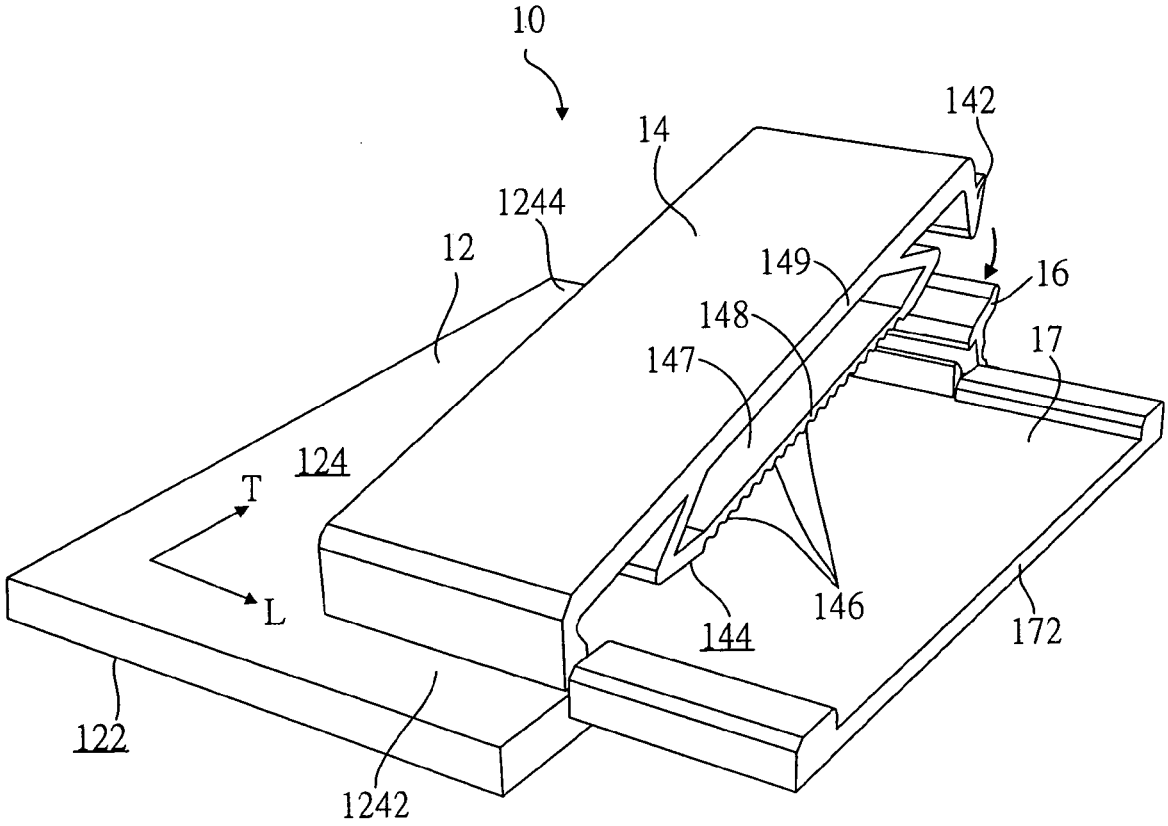
FIG. 1C is a schematic diagram of a deformation of an auxiliary fastening device of a first preferred embodiment according to the present invention.
Figure 1D:
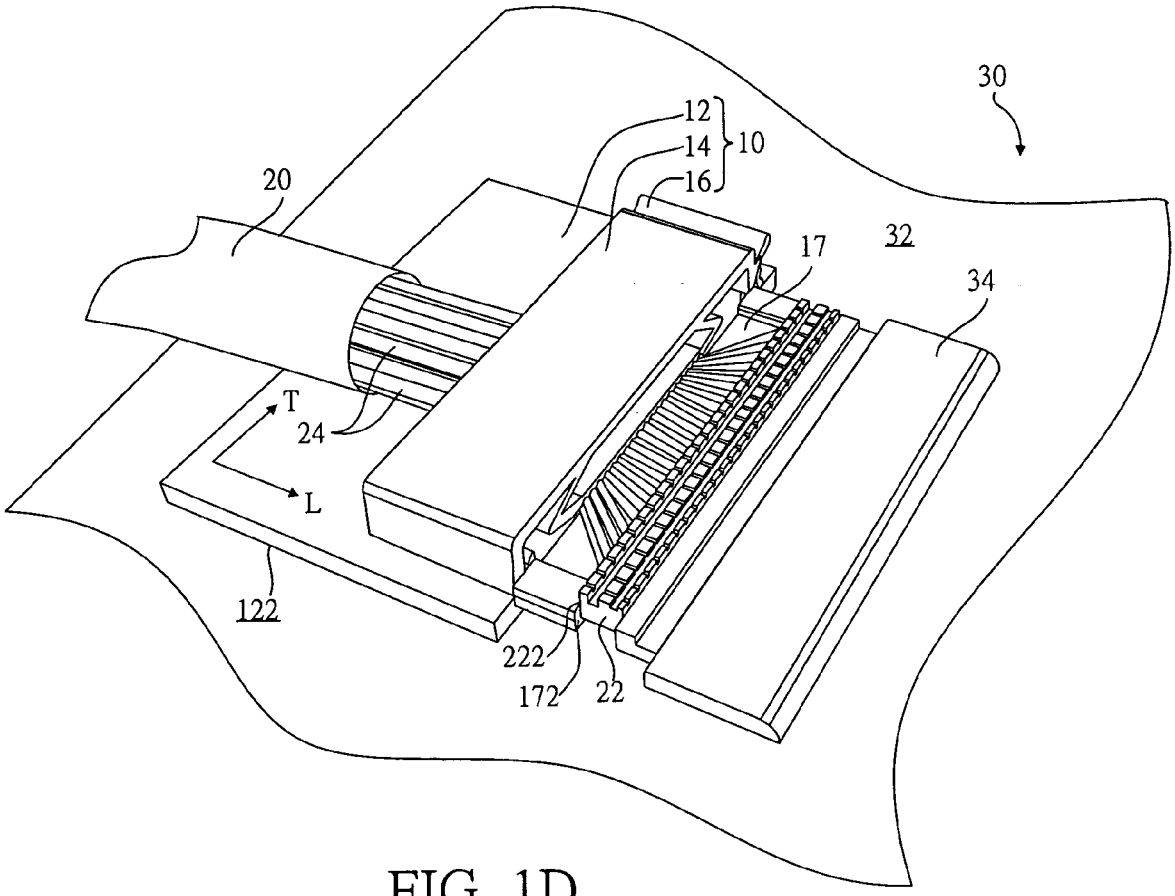
FIG. 1D is a schematic diagram of an auxiliary fastening device shown in FIG. 1C for assisting a cable being fastened onto a surface of an electronic apparatus.

As shown in FIG. 1C, in another preferred embodiment, the auxiliary fastening device 10 further comprises a stage 17. The stage 17 protrudes from the base 12 in the longitudinal direction L. The stage 17 has a leading edge 172. As shown in FIG. 1D, when the second connector 22 is connected to the fist connector 34, the leading edge 172 of the stage 17 is used for abutting against the lower edge of a shoulder 222 of the second connector 22. Obviously, the connection between the second connector 22 and the first connector 34 may be made stronger this way.

Figure 1E:
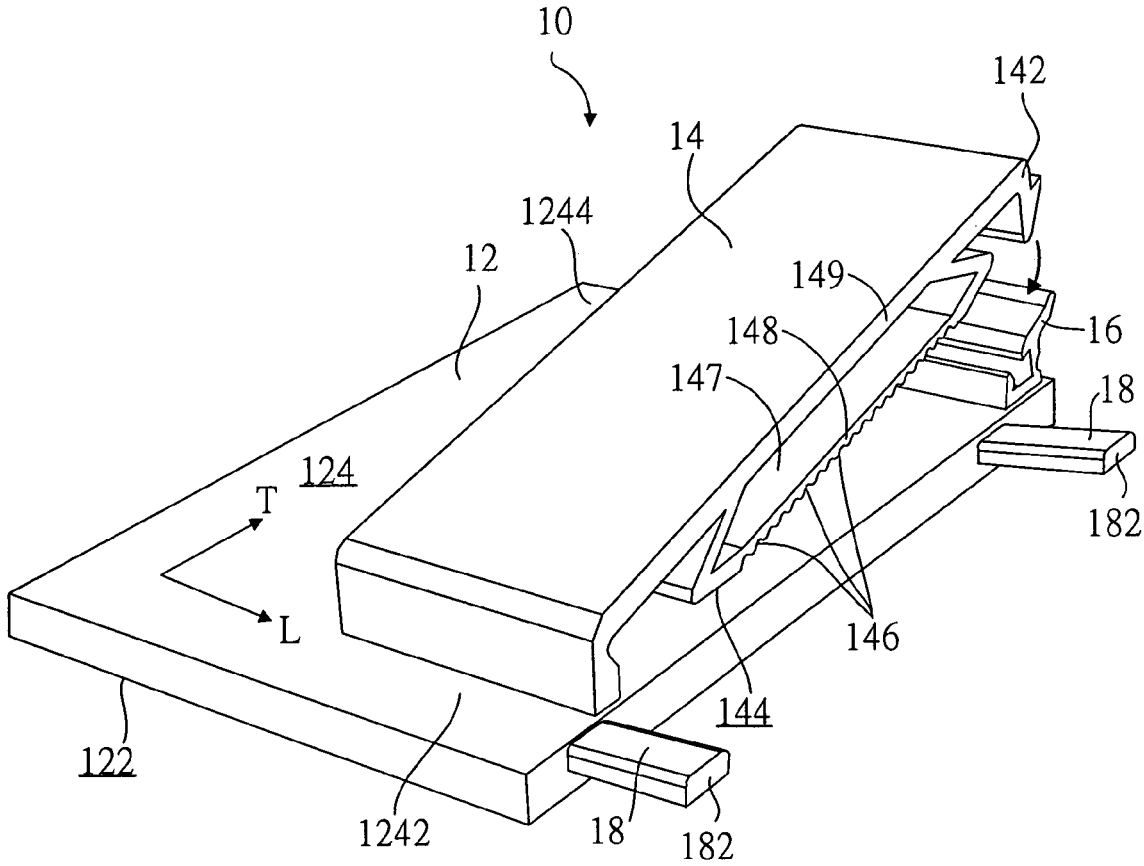
FIG. 1E is a schematic diagram of another deformation of an auxiliary fastening device of a first preferred embodiment according to the present invention.

As shown in FIG. 1E, in another preferred embodiment, the auxiliary fastening device 10 further comprises at least one withstanding boss 18 with the same length. For example, there are two withstanding bosses 18 shown in FIG. 1E. Each of the withstanding bosses 18 protrudes from the base 12 in the longitudinal direction L and has a leading edge 182. The function of the withstanding boss 18 shown in FIG. 1E is similar to the stage 17 shown in FIG. 1C. In other words, when the second connector 22 is connected to the fist connector 34, the leading edge 182 of the withstanding boss 18 is used for abutting against the lower edge (not shown in FIG.) of a shoulder 222 of the second connector 22. Obviously, the connection between the second connector 22 and the first connector 34 may be made stronger this way.

Figure 1F:
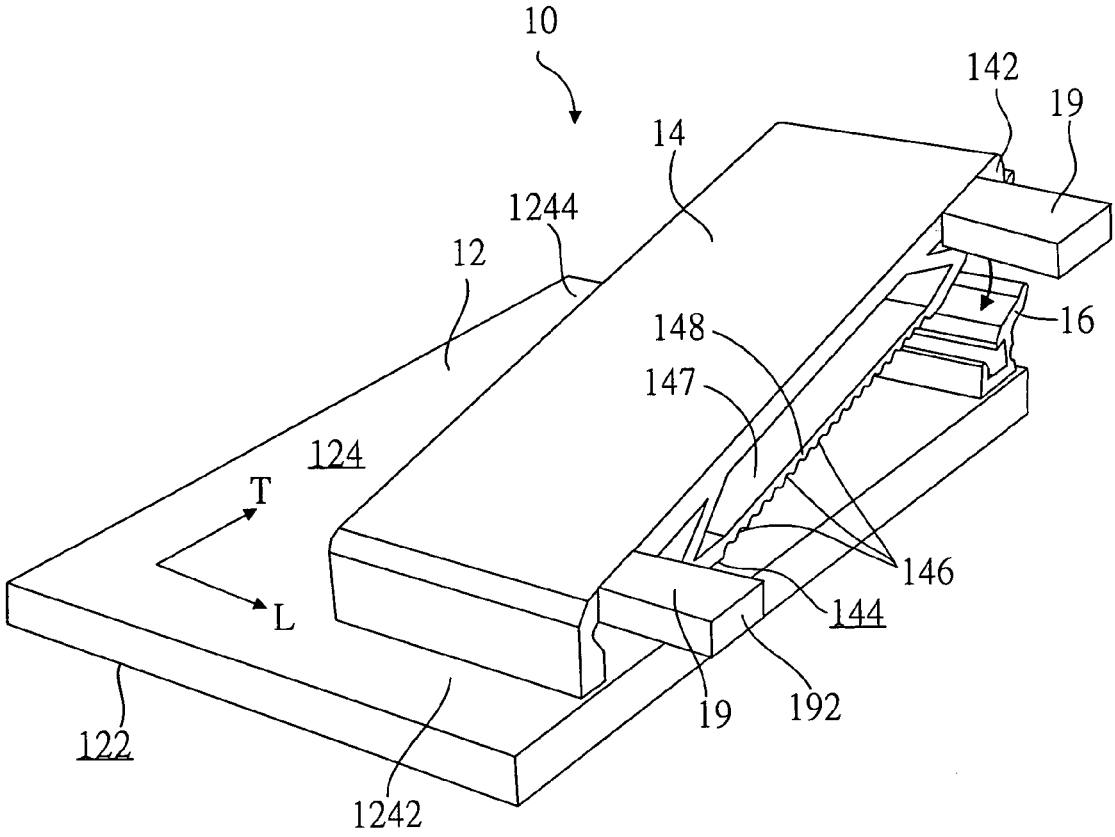
FIG. 1F is a schematic diagram of another deformation of an auxiliary fastening device of a first preferred embodiment according to the present invention.

As shown in FIG. 1F, in another preferred embodiment, the auxiliary fastening device 10 further comprises at least one withstanding boss 19 with the same length. Each of the withstanding bosses 19 protrudes from the fastening member 14 in the longitudinal direction L. For example, there are two withstanding bosses 19 shown in FIG. 1F. Each of the withstanding bosses 19 has a leading edge 192. The function of the withstanding boss 19 shown in FIG. 1F is similar to the stage 17 shown in FIG. 1C and the withstanding boss 18 shown in FIG. 1E. In other words, when the second connector 22 is connected to the fist connector 34, the leading edge 192 of the withstanding boss 19 shown in FIG. 1F is used for abutting against the top edge (not shown in FIG.) of a shoulder 222 of the second connector 22. Obviously, the connection between the second connector 22 and the first connector 34 may be made stronger this way. Moreover, the above design, which fastens the cable 20 by the auxiliary fastening device 10, is convenient to remove.

Figure 2A:
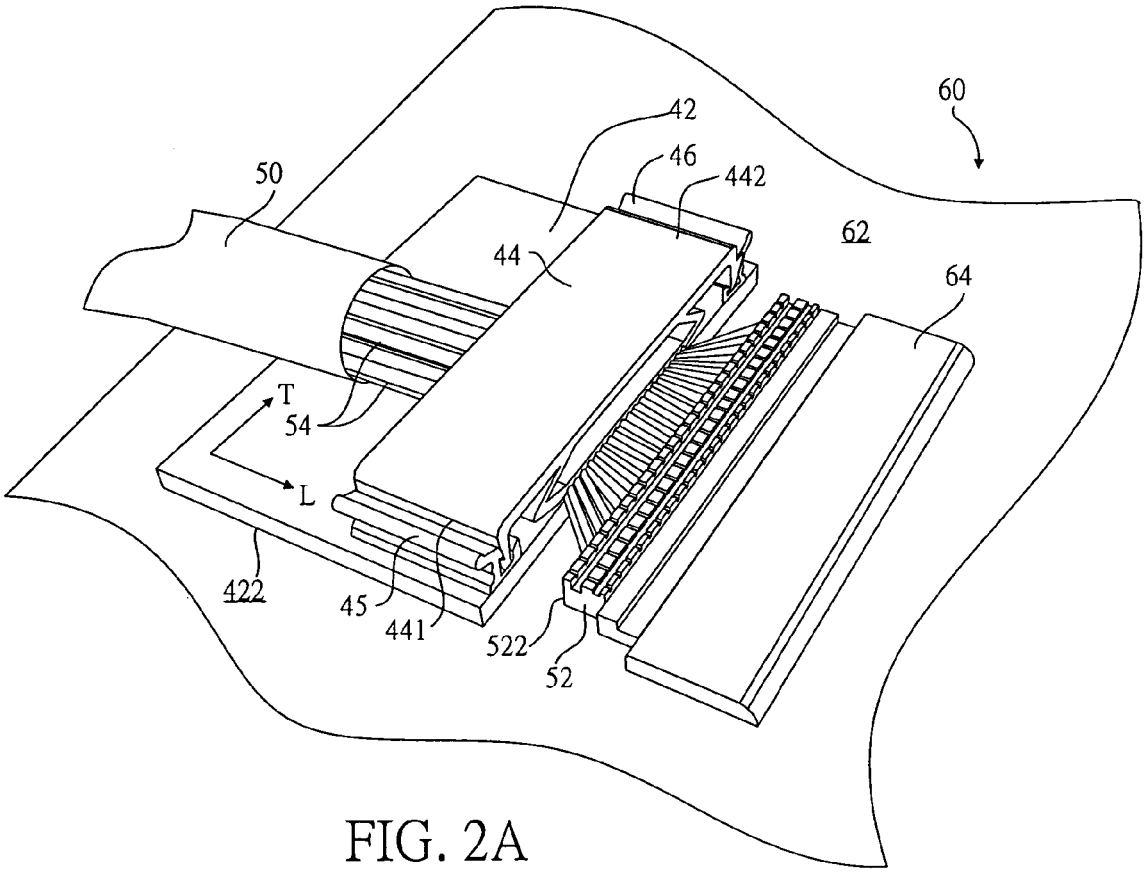
FIG. 2A is a schematic diagram of an auxiliary fastening device for assisting a cable being fastened onto a surface of an electronic apparatus of a second preferred embodiment according to the present invention.

Please refer to FIG. 2A to FIG. 2F. An auxiliary fastening device 40 of a second preferred embodiment according to the present invention is described in detail in the above figures. As shown in FIG. 2A, the auxiliary fastening device 40 is used for assisting a cable 50 being fastened onto a surface 62 of an electronic apparatus 60. A first connector 64 is disposed on the surface 62 of the electronic apparatus 60 for communicating with external signals. The cable 50 comprises a second connector 52 adapted to the first connector 64 and a plurality of signal lines 54 coupled to the second connector 52.

Figure 2B:
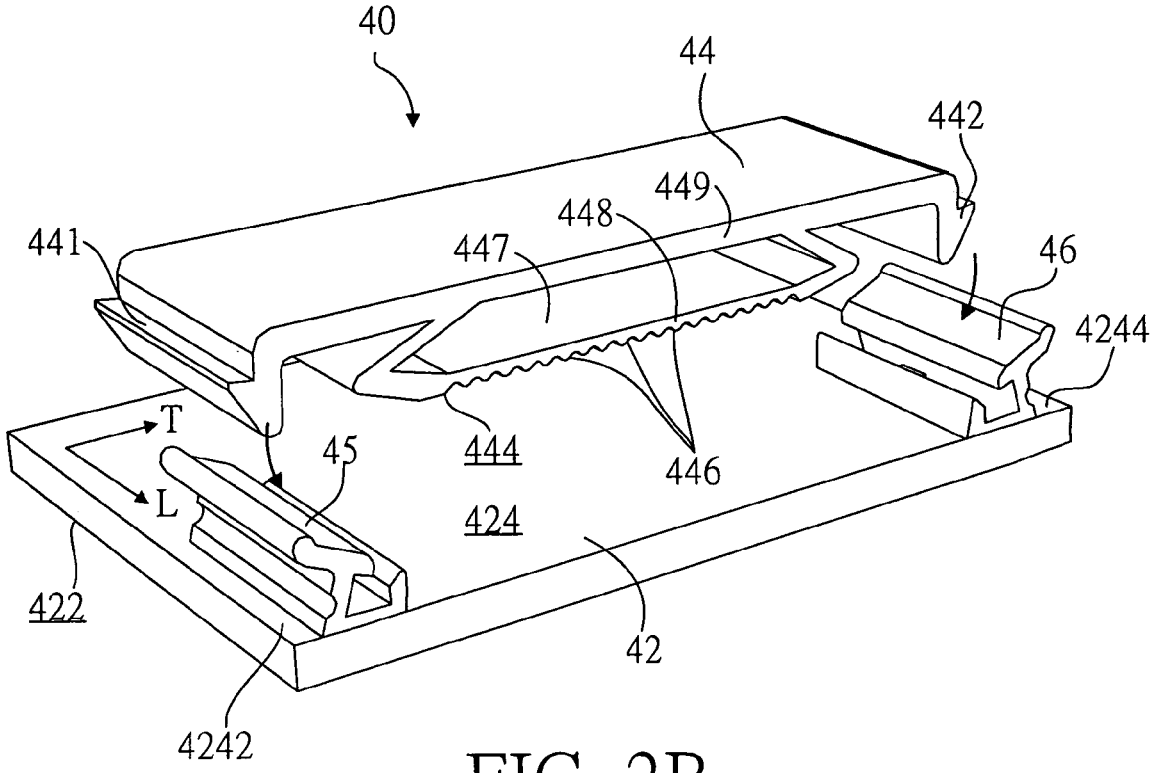
FIG. 2B is a schematic diagram of an auxiliary fastening device of a second preferred embodiment according to the present invention.

Please refer to FIG. 2B. The auxiliary fastening device 40 comprises a base 42, a fastening member 44, a first clamping member 45, and a second clamping member 46.

As shown in FIG. 2B, the base 42 has a bottom surface 422 and a top surface 424, thereon defining a longitudinal direction L and a transverse direction T. A first side 4242 and a second side 4244 opposite to the first side 4242 are defined on the top surface 424 in the transverse direction T.

As shown in FIG. 2B, the fastening member 44 has a first end 441 and a second end 442. The first end 441 and the second end 442 are normally free and made in a form of a retainer respectively. The fastening member 44 also has a lower surface 444 corresponding to the top surface 424 of the base 42.

As shown in FIG. 2B, the first clamping member 45 is disposed on the first side 4242 of the base 42 and is capable of being made into the clamping engagement with the first end 441 of the fastening member 44. The second clamping member 46 is disposed on the second side 4244 of the base 42 and is capable of being made into the clamping engagement with the second end 442 of the fastening member 44.

In the process of practical fabricating, first, the second connector 52 is connected to the first connector 64. Then, the signal lines 52 are disposed on the top surface 424 of the base 42. The first end 441 of the fastening member 44 is then forced into the clamping engagement with the first clamping member 45, and the second end 442 of the fastening member 44 is forced into the clamping engagement with the second clamping member 46, such that the signal lines 54 are disposed and fastened between the lower surface 444 of the fastening member 44 and the top surface 424 of the base 42. Finally, the auxiliary fastening device 40 is, via the bottom surface 422 of the base 42, mounted onto the surface 62 of the electronic apparatus 60. By this way, the auxiliary fastening device 30 assists the cable 40 being fastened onto the surface 62 of the electronic apparatus 60 and strongly connects the second connector 52 of the cable 50 and the first connector 64 of the electronic apparatus 60, as shown in FIG. 2A. In a preferred embodiment, the auxiliary fastening device 40 enables the base 42 to be attached to the surface 62 of the electronic apparatus 60. In another preferred embodiment, the auxiliary fastening device 40 fastens the base 42 on the surface 62 of the electronic apparatus 60 with at least one screw.

Obviously, when the cable 50 is pulled by sudden external tensile force, due to the fact that the auxiliary fastening device 40 can resist the sudden external tensile force, the second connector 52 connected to the first connector 64 will not have bad contact resulted from the sudden external tensile force, nor will it fall off.

In a preferred embodiment, as shown in FIG. 2B, the auxiliary fastening device 40 further comprises a plurality of grooves 446, which elongate in the longitudinal direction L; it also extends along in the transverse direction T, and that is formed on the bottom surface 444 of the fastening member 44. As shown in FIG. 2A, the plurality of signal lines 54 is not in the form of a bundle but separated from each other near the second connector 52. Each of the grooves 446 is especially sized to accept one of the signal lines 54 of the cable 50. When the plurality of signal lines 54 are disposed and fastened between the bottom surface 444 of the fastening member 44 and the top surface 424 of the base 42, each signal line 54 is disposed and fastened in each of the grooves 446.

In a preferred embodiment, as shown in FIG. 2B, the fastening member 44 has a hollow portion 447 formed on the bottom surface 444, so that a retained portion 448 between the bottom surface 444 and the hollow portion 447 is deformable. By this way, when each signal line 442 is disposed and fastened in each of the grooves 446, a pressure induced by the deformed retained portion 448 is applied to the plurality of signal lines 54. Therefore, the auxiliary fastening device 40 can resist larger external tensile force.

Figure 2C:
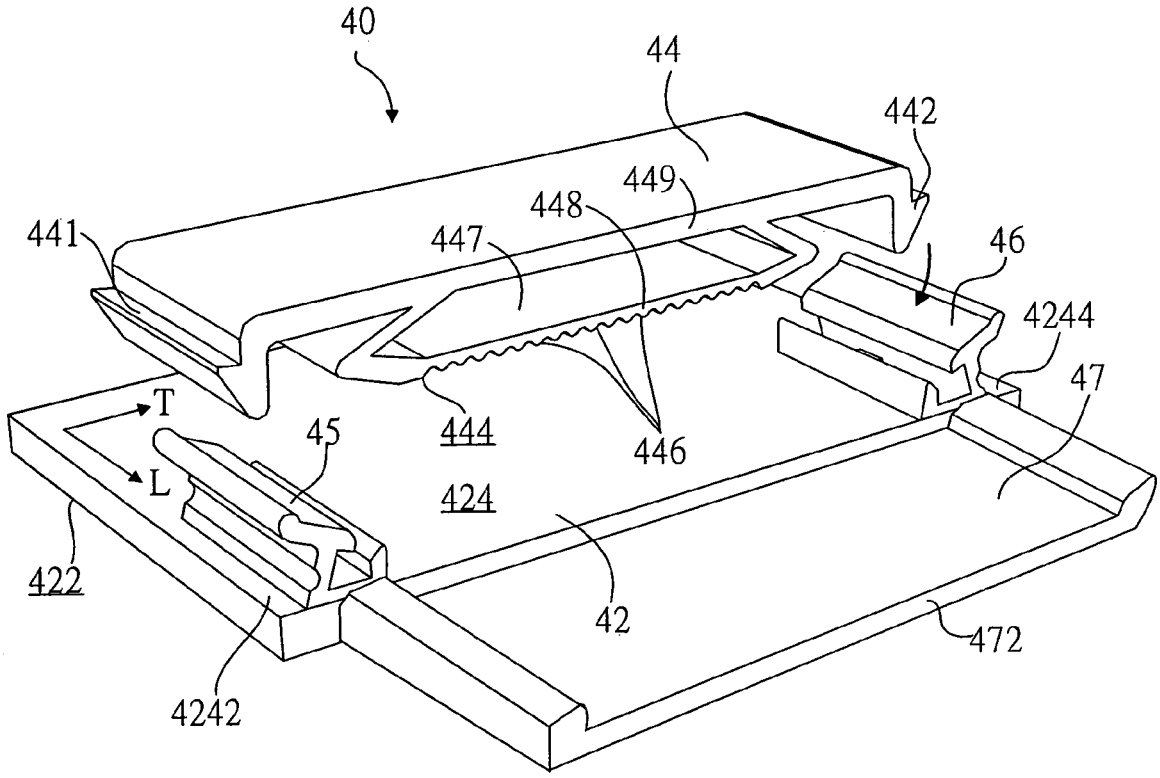
FIG. 2C is a schematic diagram of a deformation of an auxiliary fastening device of a second preferred embodiment according to the present invention.
Figure 2D:
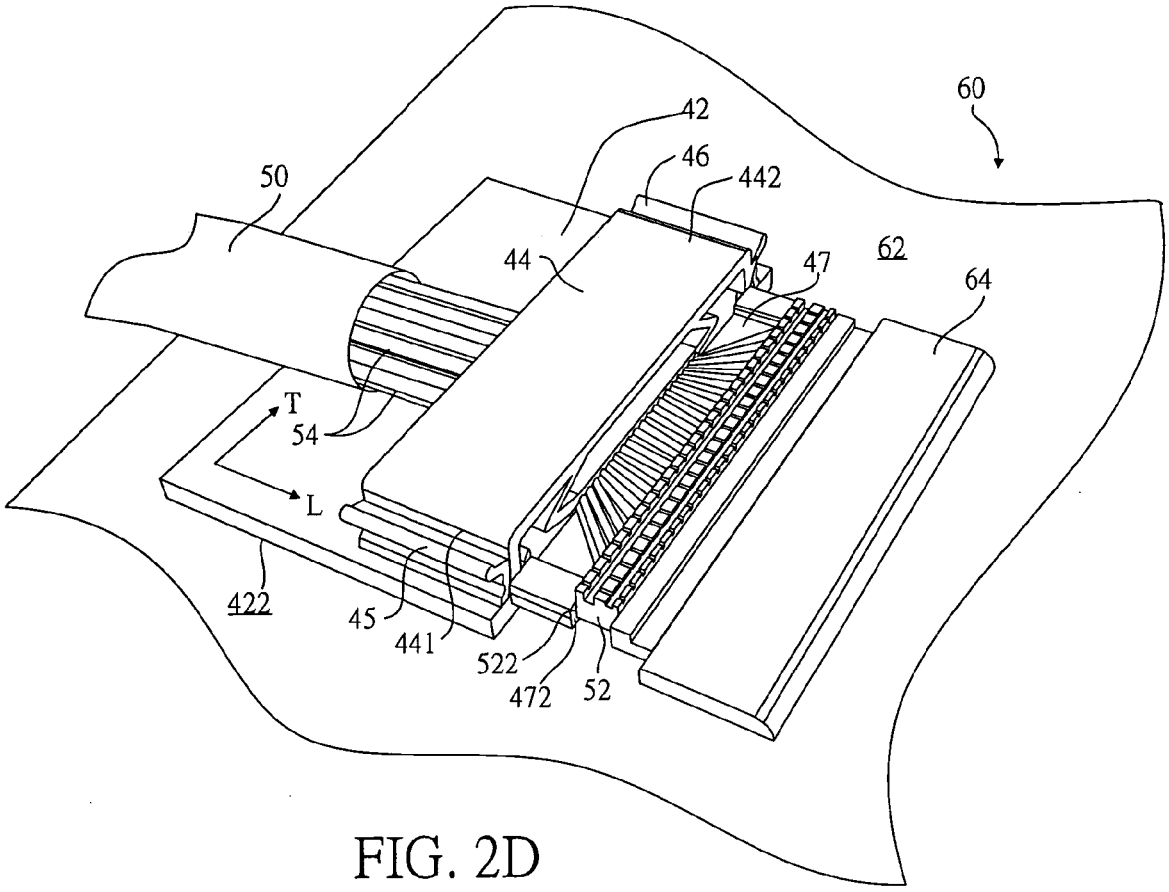
FIG. 2D is a schematic diagram of an auxiliary fastening device shown in FIG. 2C for assisting a cable being fastened onto a surface of an electronic apparatus.

As shown in FIG. 2C, in another preferred embodiment, the auxiliary fastening device 40 further comprises a stage 47. The stage 47 protrudes from the base 42 in the longitudinal direction L. The stage 47 has a leading edge 472. As shown in FIG. 2D, when the second connector 52 is connected to the fist connector 64, the leading edge 472 of the stage 47 is used for abutting against the lower edge of a shoulder 522 of the second connector 52. Obviously, the connection between the second connector 52 and the first connector 64 may be made stronger this way.

Figure 2E:
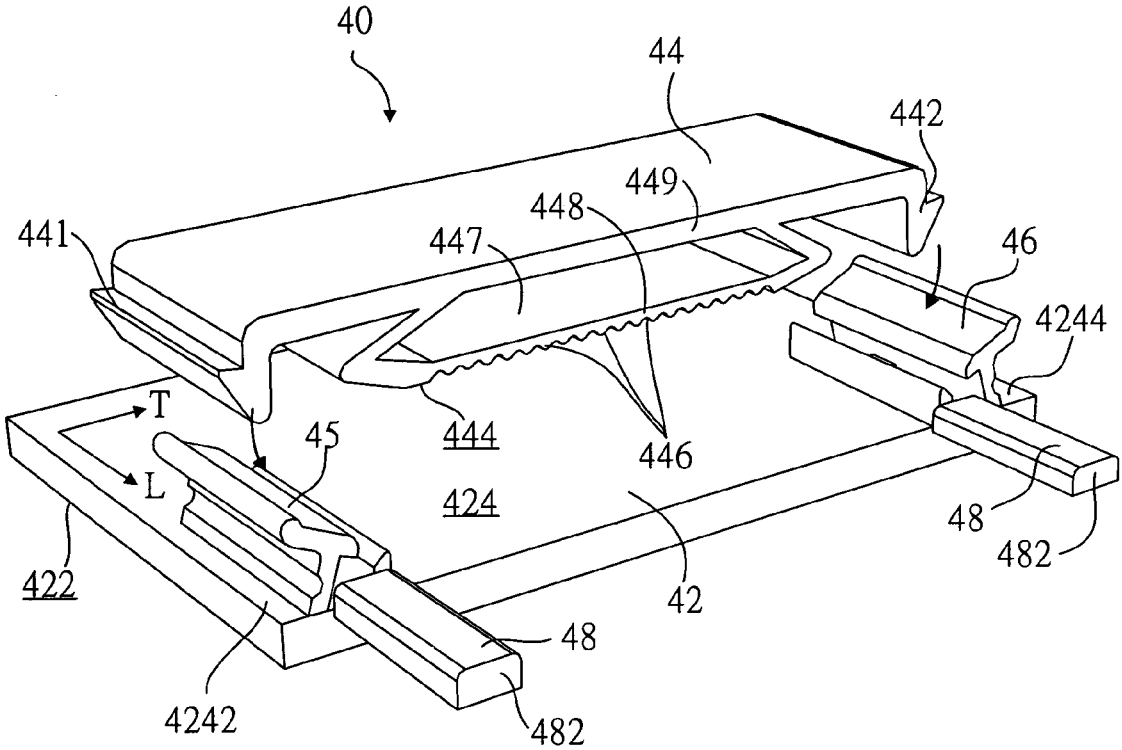
FIG. 2E is a schematic diagram of another deformation of an auxiliary fastening device of a second preferred embodiment according to the present invention.

As shown in FIG. 2E, in another preferred embodiment, the auxiliary fastening device 40 further comprises at least one withstanding boss 48 with the same length. For example, there are two withstanding bosses 48 shown in FIG. 2E. Each of the withstanding bosses 48 protrudes from the base 42 in the longitudinal direction L and has a leading edge 482. The function of the withstanding boss 48 shown in FIG. 2E is similar to the stage 47 shown in FIG. 2C. In other words, when the second connector 52 is connected to the first connector 64, the leading edge 482 of the withstanding boss 48 is used for abutting against the lower edge (not shown in FIG.) of a shoulder 222 of the second connector 22. Obviously, the connection between the second connector 52 and the first connector 64 may be made stronger this way.

Figure 2F:
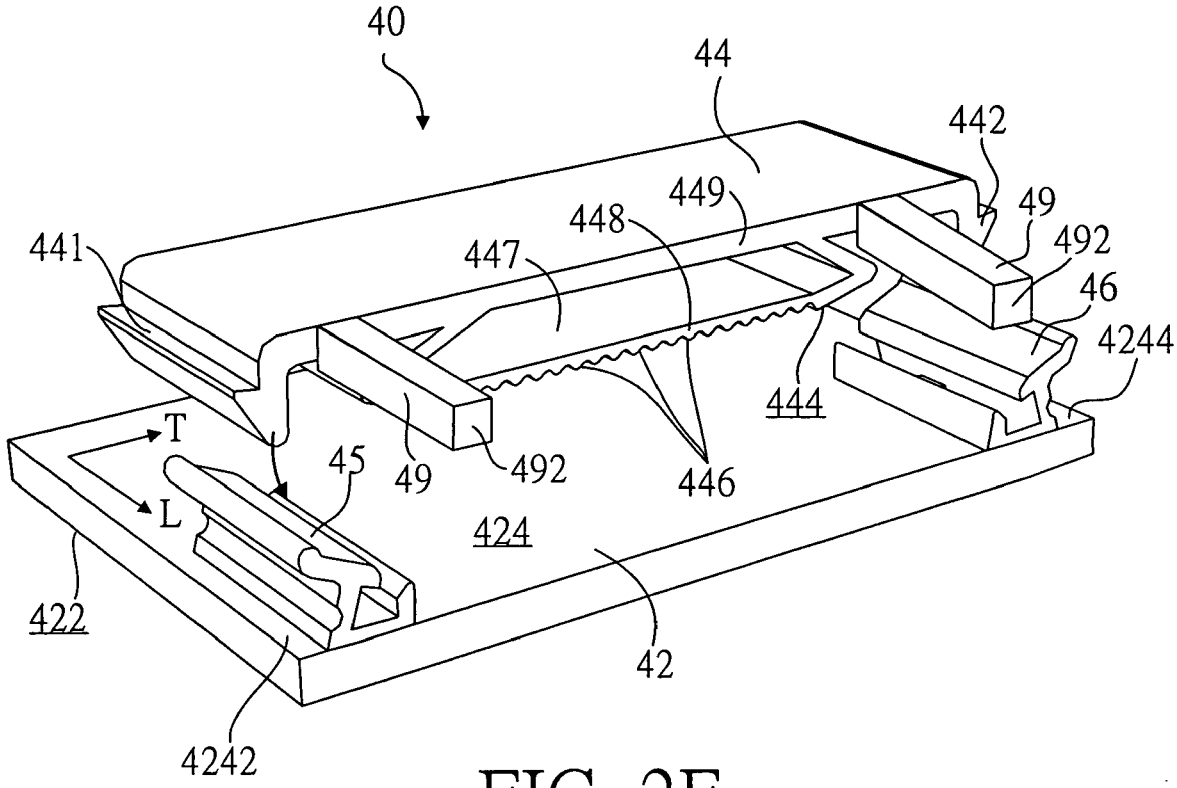
FIG. 2F is a schematic diagram of another deformation of an auxiliary fastening device of a second preferred embodiment according to the present invention.

As shown in FIG. 2F, in another preferred embodiment, the auxiliary fastening device 40 further comprises at least one withstanding boss 49 with the same length. Each of the withstanding bosses 49 protrudes from the fastening member 44 in the longitudinal direction L. For example, there are two withstanding bosses 49 shown in FIG. 2F. Each of the withstanding bosses 49 has a leading edge 492. The function of the withstanding boss 49 shown in FIG. 2F is similar to the stage 47 shown in FIG. 2C and the withstanding boss 48 shown in FIG. 2E. In other words, when the second connector 52 is connected to the first connector 64, the leading edge 492 of the withstanding boss 49 shown in FIG. 2F is used for abutting against the top edge (not shown in FIG.) of a shoulder 522 of the second connector 52. Obviously, the connection between the second connector 52 and the first connector 64 may be made stronger this way. Moreover, the above design, which fastens the cable 50 by the auxiliary fastening device 40, is convenient to remove.

Furthermore, to reduce the manufacture cost, the auxiliary fastening device of the present invention may be manufactured by injection molding with macromolecule material.

Moreover, there are not a lot of limits about the design of size of the auxiliary fastening device according to the present invention. As long as the number of the grooves of the auxiliary fastening device according to the present invention exceeds the number of the signal lines of the cable necessary to be fastened, the auxiliary fastening device of the present invention may be used for assisting the cable being fastened onto the surface of the electronic apparatus. Compared with the prior art, the auxiliary fastening device of the present invention can be utilized extensively.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. An auxiliary fastening device for assisting a cable being fastened onto a surface of an electronic apparatus comprising a first connector disposed on the surface of the electronic apparatus, the cable comprising a second connector adapted to the first connector and a plurality of signal lines coupled to the second connector, the auxiliary fastening device comprising:

a base having a bottom surface and a top surface, thereon defining a longitudinal direction and a transverse direction, a first side and a second side opposite to the first side being defined on the top surface in the transverse direction;

a fastening member protruding from the first side of the base in the transverse direction and having a tail end which is normally free and made in a form of a retainer, the tail end of the fastening member being selectively disposed in a closed position, the fastening member also having a lower surface corresponding to the top surface of the base;

a clamping member disposed on the second side of the base, the tail end of the fastening member being made into the clamping engagement with the clamping member when the tail end of the fastening member is disposed in the closed position; and wherein when the second connector is connected to the first connector, the signal lines are disposed on the top surface of the base, the tail end of the fastening member is then forced to the closed position such that the signal lines are disposed and fastened between the lower surface of the fastening member and the top surface of the base, and the auxiliary fastening device is, via the bottom surface of the base, mounted onto the surface of the electronic apparatus.

2. The auxiliary fastening device of claim 1, wherein the fastening member also has a hollow portion formed over the lower surface such that a first retained portion between the lower surface and the hollow portion is deformable.

3. The auxiliary fastening device of claim 2, wherein the signal lines, near the second connector, are not bundled but are spaced, a plurality of grooves are elongated in the longitudinal direction and formed in the transverse direction across the lower surface of the fastening member, each of the grooves is sized to accept one of the signal lines, when the signal lines are disposed and fastened between the lower surface of the fastening member and the top surface of the base, each of the signal lines is fitted and retained in one of the grooves, and a pressure, induced by the deformed first retained portion, is applied to the signal lines.

4. The auxiliary fastening device of claim 1, further comprising a stage protruding from the base in the longitudinal direction, the stage having a leading edge for abutting against a shoulder of the second connector when the second connector is connected to the first connector.

5. The auxiliary fastening device of claim 1, further comprising at least one withstanding boss protruding from the base in the longitudinal direction, each of at least one withstanding boss having a leading edge for abutting against the shoulder of the second connector when the second connector is connected to the first connector.

6. The auxiliary fastening device of claim 1, further comprising at least one withstanding boss protruding from the fastening member in the longitudinal direction, each of at least one withstanding boss having a leading edge for abutting against the shoulder of the second connector when the second connector is connected to the first connector.

7. An auxiliary fastening device for assisting a cable being fastened onto a surface of an electronic apparatus comprising a first connector disposed on the surface of the electronic apparatus, the cable comprising a second connector adapted to the first connector and a plurality of signal lines coupled to the second connector, the auxiliary fastening device comprising:

a base having a bottom surface and a top surface, thereon defining a longitudinal direction and a transverse direction, a first side and a second side opposite to the first side being defined on the top surface in the transverse direction;

a fastening member having a first end and a second end which each is normally free and made in a form of a retainer, respectively, the fastening member also having a lower surface corresponding to the top surface of the base;

a first clamping member disposed on the first side of the base and capable of being made into the clamping engagement with the first end of the fastening member;

a second clamping member disposed on the second side of the base and capable of being made into the clamping engagement with the second end of the fastening member; and wherein when the second connector is connected to the first connector, the signal lines are disposed on the top surface of the base, the first end of the fastening member is then forced into the clamping engagement with the first clamping member, and the second end of the fastening member is forced into the clamping engagement with the second clamping member, such that the signal lines are disposed and fastened between the lower surface of the fastening member and the top surface of the base, and the auxiliary fastening device is, via the bottom surface of the base, mounted onto the surface of the electronic apparatus.

8. The auxiliary fastening device of claim 7, wherein the fastening member also has a hollow portion formed over the lower surface such that a first retained portion between the lower surface and the hollow portion is deformable.

9. The auxiliary fastening device of claim 8, wherein the signal lines, near the second connector, are not bundled but are spaced, a plurality of grooves are elongated in the longitudinal direction and formed in the transverse direction across the lower surface of the fastening member, each of the grooves is sized to accept one of the signal lines, when the signal lines are disposed and fastened between the lower surface of the fastening member and the top surface of the base, each of the signal lines is fitted and retained in one of the grooves, and a pressure, induced by the deformed first retained portion, is applied to the signal lines.

10. The auxiliary fastening device of claim 7, further comprising a stage protruding from the base in the longitudinal direction, the stage having a leading edge for abutting against a shoulder of the second connector when the second connector is connected to the first connector.

11. The auxiliary fastening device of claim 7, further comprising at least one withstanding boss protruding from the base in the longitudinal direction, each of the least one withstanding boss having a leading edge for abutting against the shoulder of the second connector when the second connector is connected to the first connector.

12. The auxiliary fastening device of claim 7, further comprising at least one withstanding boss protruding from the fastening member in the longitudinal direction, each of at least one withstanding boss having a leading edge for abutting against the shoulder of the second connector when the second connector is connected to the first connector.

* * * * *